US007584768B2

(12) United States Patent
Westerkamp et al.

(10) Patent No.: US 7,584,768 B2
(45) Date of Patent: Sep. 8, 2009

(54) WOVEN BELT FOR A MACHINE FOR PRODUCING WEB MATERIAL AND METHOD FOR MANUFACTURING SUCH A WOVEN BELT

(75) Inventors: Arved H. Westerkamp, Dettingen/Erms (DE); Petra Hack-Ueberall, Reutlingen (DE)

(73) Assignee: Voith Patent GmbH, Heidenheim (DE)

( * ) Notice: Subject to any disclaimer, the term of this patent is extended or adjusted under 35 U.S.C. 154(b) by 72 days.

(21) Appl. No.: 11/958,657

(22) Filed: Dec. 18, 2007

(65) Prior Publication Data

US 2008/0214346 A1 Sep. 4, 2008

(30) Foreign Application Priority Data

Dec. 22, 2006 (DE) ..... 10 2006 061 114

(51) Int. Cl.
*D21F 7/10* (2006.01)
*D21F 7/08* (2006.01)
*D03D 25/00* (2006.01)

(52) U.S. Cl. ..... 139/383 A; 139/383 AA; 139/408; 139/414; 162/358.2

(58) Field of Classification Search ..... 139/383 R, 139/383 A, 383 AA, 408, 411, 412, 413, 139/414; 162/348, 358.1, 358.2, 900, 902, 162/903, 904
See application file for complete search history.

(56) References Cited

U.S. PATENT DOCUMENTS 4,934,414 A 6/1990 Borel
5,421,374 A * 6/1995 Wright ..... 139/383 A
5,465,764 A * 11/1995 Eschmann et al. ..... 139/383 A
6,145,550 A * 11/2000 Ward ..... 139/383 A
6,546,964 B1 * 4/2003 Westerkamp ..... 139/383 A
6,810,917 B2 * 11/2004 Stone ..... 139/383 A
6,827,821 B2 * 12/2004 Brewster et al. ..... 162/358.2
6,926,043 B2 * 8/2005 Quigley et al. ..... 139/383 A (Continued)

*Primary Examiner*—Bobby H Muromoto, Jr.
(74) *Attorney, Agent, or Firm*—Taylor & Aust, P.C.

(57) ABSTRACT

A woven belt for a machine for producing web material, in particular forming mesh, including at least two woven layers with warp threads extending in a belt longitudinal direction and weft threads extending in a belt transverse direction, wherein a first of the woven layers provides a web material contact side and a second of the woven layers provides a machine contact side and the woven layers are joined together by tie warp threads, wherein the first woven layer is woven with at least 26 different warp runs, the structure-forming warp threads woven into the first woven layer and the weft threads of the first woven layer having a maximum floating length of 3 in relation to each other, wherein, when the tie warp threads for providing structure-forming tie thread pairs are arranged in pairs relative to each other so that where a tie warp thread of a respective structure-forming tie warp thread pair is integrated into the first woven layer then the other tie warp thread of this structure-forming tie warp thread pair is integrated into another woven layer, then changeover points at which the tie warp threads of the structure-forming tie warp thread pairs cross each other for switching between the first woven layer and the other woven layer are distributed irregularly within a warp/weft repeat, or wherein, when the tie warp threads are integrated into the first woven layer with no structure-forming effect and tie onto tie-on points over weft threads of the first woven layer, then the tie-on points within a warp/weft repeat are distributed irregularly.

18 Claims, 15 Drawing Sheets

U.S. PATENT DOCUMENTS

| | | | | |
|---|---|---|---|---|
| 7,249,615 | B2 | 7/2007 | Westerkamp et al. | |
| 7,472,726 | B2 * | 1/2009 | Hack-Ueberall | 139/383 A |
| 7,493,922 | B2 * | 2/2009 | Hack-Ueberall | 139/383 A |
| 2006/0048840 | A1 | 3/2006 | Quigley | |
| 2007/0137720 | A1 | 6/2007 | Hack-Uberall | |

* cited by examiner

WOVEN BELT FOR A MACHINE FOR PRODUCING WEB MATERIAL AND METHOD FOR MANUFACTURING SUCH A WOVEN BELT

BACKGROUND OF THE INVENTION

1. Field of the Invention

This invention relates to a woven belt for a machine for producing web material, in particular forming mesh, including at least two woven layers with warp threads extending in a belt longitudinal direction and weft threads extending in a belt transverse direction, wherein a first of the woven layers provides a web material contact side and a second of the woven layers provides a machine contact side and the woven layers are joined together by tie warp threads. In addition this invention relates to a method with which such a woven belt can be manufactured.

2. Description of the Related Art

In the case of woven belts of the type used for example as forming meshes on machines for producing web material such as paper or paperboard, an elementary requirement is that there should be as little tendency as possible to marking in the web material to be produced. This means that the structure of the woven belt should impress itself as little as possible in the web material to be produced because such an impression of the structure, generally referred to as marking, impairs the quality of the produced web material.

Markings are produced above all when a very regular tie structure or weave structure exists in the woven belt. Hence there is a general endeavor to make the repeat lengths in both the warp direction and the weft direction, meaning in general the size of a warp/weft repeat, as large as possible. In this way it is possible to obtain a greater diversity of variation of the mutual tie points of warp threads and weft threads as well as an accordingly greater irregularity of said tie points.

What is needed in the art is a woven belt for a machine for producing web material and a method for manufacturing such a woven belt, by way of which an improved weave structure with a smaller tendency to marking is obtained.

The term "tendency to marking" is understood in this context to mean for example a line-shaped marking which extends for example in the warp or weft direction or in a diagonal direction thereto.

SUMMARY OF THE INVENTION

According to a first aspect of the invention, the present invention provides a woven belt for a machine for producing web material, in particular forming mesh, including at least two woven layers with warp threads extending in a belt longitudinal direction and weft threads extending in a belt transverse direction, wherein a first of the woven layers provides a web material contact side and a second of the woven layers provides a machine contact side and the woven layers are joined together by tie warp threads, wherein the first woven layer is woven with at least 26 different warp runs, the structure-forming warp threads woven into the first woven layer and the weft threads of the first woven layer having a maximum floating length of 3 in relation to each other, wherein, when the tie warp threads for providing structure-forming tie thread pairs are arranged in pairs relative to each other so that where a tie warp thread of a respective structure-forming tie warp thread pair is integrated into the first woven layer then the other tie warp thread of this structure-forming tie warp thread pair is integrated into another woven layer, then changeover points at which the tie warp threads of the structure-forming tie warp thread pairs cross each other for switching between the first woven layer and the other woven layer are distributed irregularly within a warp/weft repeat, or wherein, when the tie warp threads are integrated into the first woven layer with no structure-forming effect and tie onto tie-on points over weft threads of the first woven layer, then the tie-on points within a warp/weft repeat are distributed irregularly.

In the case of the inventive woven belt it is first clear that said belt is a warp-tied woven belt, meaning that the connection between various woven layers is produced by warp threads. Said threads can be provided either as structure-forming warp thread pairs which contribute to forming the structure where they are integrated into the woven layer providing the web material contact side or which produce a strong connection between woven layers by switching between said layers. On the other hand provision can be made for so-called non-structure-forming tie warp threads which are not integrated primarily into the woven layer providing the web material contact side and which are tied only to a few points, so-called tie-on points, over weft threads of the first woven layer and thus produce the connection between various woven layers.

By providing at least 26 different warp runs, meaning at least 26 different ways in which the warp threads integrated into the first woven layer are tied in relation to the weft threads of the first woven layer, a very large repeat length is produced and extends over at least 26 warp threads. This makes it possible in turn for the changeover points of so-called structure-forming tie warp thread pairs or the tie-on points of non-structure-forming warp threads within a respective warp/weft repeat to be positioned with great freedom of variation such that the occurrence of a regular pattern of such changeover points or tie-on points can be avoided so that said points are distributed irregularly in a respective repeat.

The first woven layer (G1) can be woven with 32 or more, 38 or more or 45 or more different warp runs.

According to another particularly advantageous aspect provision is made on the inventive woven belt for each structure-forming tie warp thread pair within a warp/weft repeat to have at least two changeover points and for all the changeover points on no more than two, preferably on no structure-forming tie warp thread pairs to lie on the same weft threads of the first woven layer.

The measure of providing within one warp/weft repeat no more than three structure-forming tie warp thread pairs on which all changeover points lie on the same weft threads of the first woven layer contributes to the changeover points within a respective warp/weft repeat being distributed irregularly.

It is advantageous for there to be at least one changeover point on at least half of the weft threads within a warp/weft repeat.

In order to obtain a stable connection of the woven layers to each other while at the same time obtaining as irregular a distribution as possible of the tie-on points of non-structure-forming tie warp threads it is proposed for each non-structure-forming tie warp thread within a warp/weft repeat to have at least two tie-on points in the first woven layer and for all tie-on points on no more than two, preferably on no non-structure-forming tie warp threads to lie on the same weft threads of the first woven layer. In this case provision can also be made for there to be within one warp/weft repeat no more than three non-structure-forming tie warp threads on which all tie-on points lie on the same weft threads of the first woven layer.

On the non-structure-forming tie warp threads it is also possible to increase the irregularity of the distribution of tie-on points within a warp/weft repeat by there being at least one tie-on point on at least half of the weft threads of the first woven layer within a warp/weft repeat.

The other woven layer can be the second woven layer, which generally means that such a woven belt is then constructed with two woven layers.

In addition provision can be made for the number of structure-forming tie warp thread pairs or the number of non-structure-forming tie warp threads to be smaller than or equal to the number of warp threads in the first woven layer which do not contribute to the connection of the woven layers.

In order to produce, in particular on the web material contact side, a comparatively high density of warp threads and weft threads and a correspondingly dense weave structure it is proposed for the number of warp threads of the first woven layer to be greater than or equal to the number of warp threads of the second woven layer. In addition provision can be made for the number of weft threads of the first woven layer to be greater than or equal to the number of weft threads of the second woven layer.

It is possible that all warp threads within a warp repeat have different warp runs.

On the inventive woven belt a contribution to a reduced tendency to marking is made in addition by at least half of the floatings between the structure-forming warp threads woven into the first woven layer and the weft threads of the first woven layer relative to each other having a floating length of less than 3.

A very irregular tie pattern can also be obtained by at least two, preferably all of the at least 26 different warp thread runs being formed not by shifting of another warp thread run in the warp direction.

According to another aspect of the invention, the present invention provides a method for manufacturing a woven belt for a machine for producing web material, in particular forming mesh, including at least two woven layers with warp threads extending in a belt longitudinal direction and weft threads extending in a belt transverse direction, wherein a first of the woven layers provides a web material contact side and a second of the woven layers provides a machine contact side and the woven layers are joined together by tie warp threads, wherein the first woven layer is woven with at least 26 different warp runs, the structure-forming warp threads woven into the first woven layer and the weft threads of the first woven layer having a maximum floating length of 3 in relation to each other, wherein, when the tie warp threads for providing structure-forming tie thread pairs are arranged in pairs relative to each other so that where a tie warp thread of a respective structure-forming tie warp thread pair is integrated into the first woven layer then the other tie warp thread of this structure-forming tie warp thread pair is integrated into another woven layer, then changeover points at which the tie warp threads of the structure-forming tie warp thread pairs cross each other for switching over between the first woven layer and the other woven layer are distributed irregularly within a warp/weft repeat, or wherein, when the tie warp threads are integrated into the first woven layer with no structure-forming effect and tie onto tie-on points over weft threads of the first woven layer, then the tie-on points within a warp/weft repeat are distributed irregularly.

The use of at least 26 shafts generally means that at least 26 different warp thread runs are generated, resulting in a correspondingly long warp repeat.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
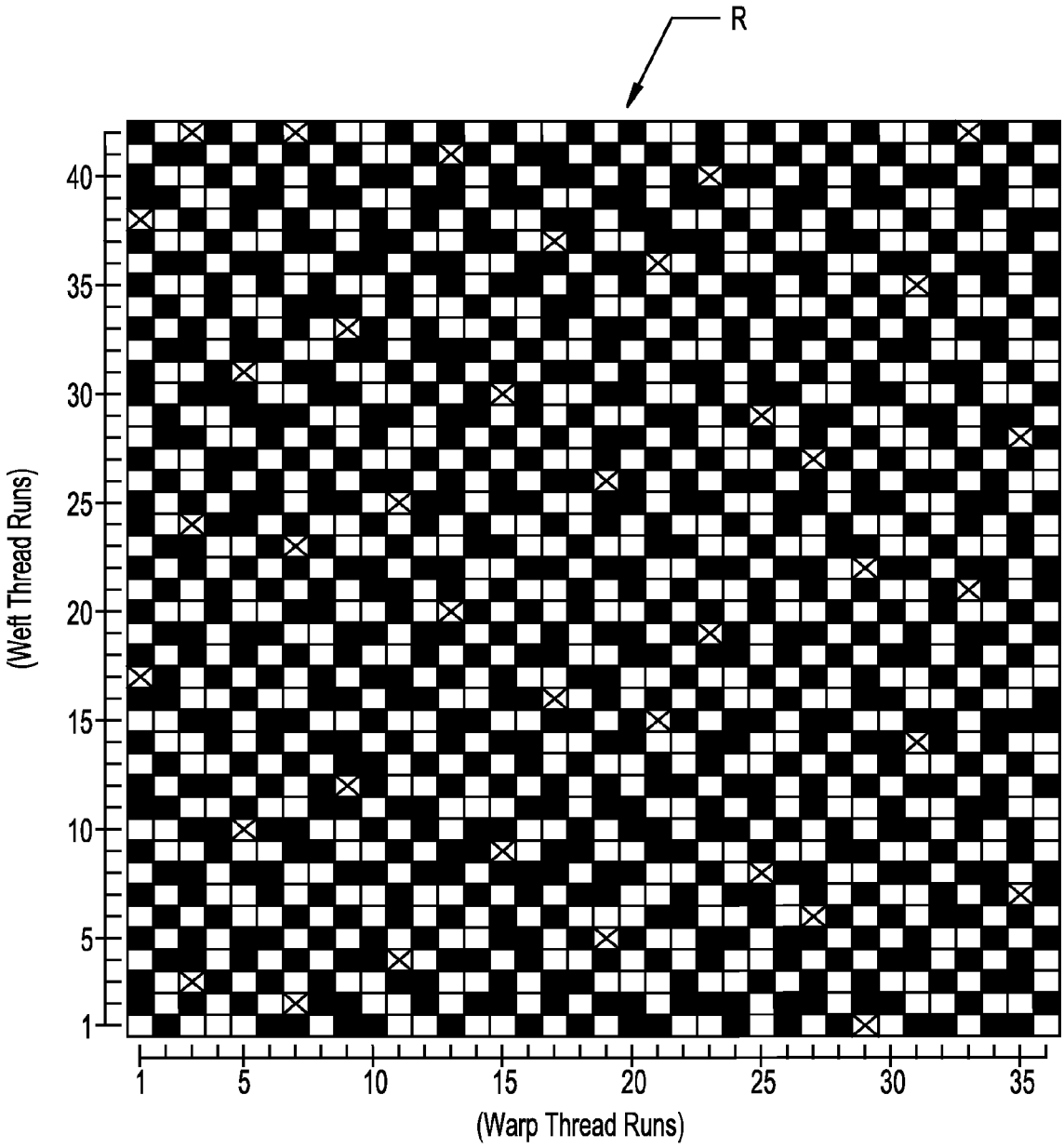
FIG. 1 shows a warp/weft repeat of a woven belt for producing web material, wherein warp lifts are indicated by a dark field, warp lowerings by a bright field and changeover points of structure-forming tie warp thread pairs with an "X"

Referring now to the drawings, and more particularly to FIGS. 1 and 2*a* to 2*f*, there is shown a first example of a tie structure of a woven belt constructed according to the principles of the invention for a machine for producing web material, for example a paper machine. Such a woven belt can be used on a paper machine as a so-called forming mesh.

FIG. 1 shows the tie pattern of a warp/weft repeat R. In this case the adjacent columns 1 to 36 designate respectively the runs of warp threads while the lines 1 to 42 orthogonal thereto represent weft thread runs. In particular it should be noted that the tie pattern illustrated here is that of a woven layer providing a web material contact side of a woven belt constructed with two woven layers G1 and G2 (see FIG. 2*a*). In FIG. 1 a respectively black marked field indicates a so-called warp lift, meaning a condition in which looking from the web material contact side a warp thread runs over a weft thread. The white marked fields indicate warp lowerings, meaning positions at which a respective warp thread runs under a weft thread of the first woven layer G1. The fields marked with "X" indicate changeover points (explained below) in which so-called structure-forming warp threads switching from one of the woven layers G1, G2 into the other of the woven layers cross each other.

Figure 2A:
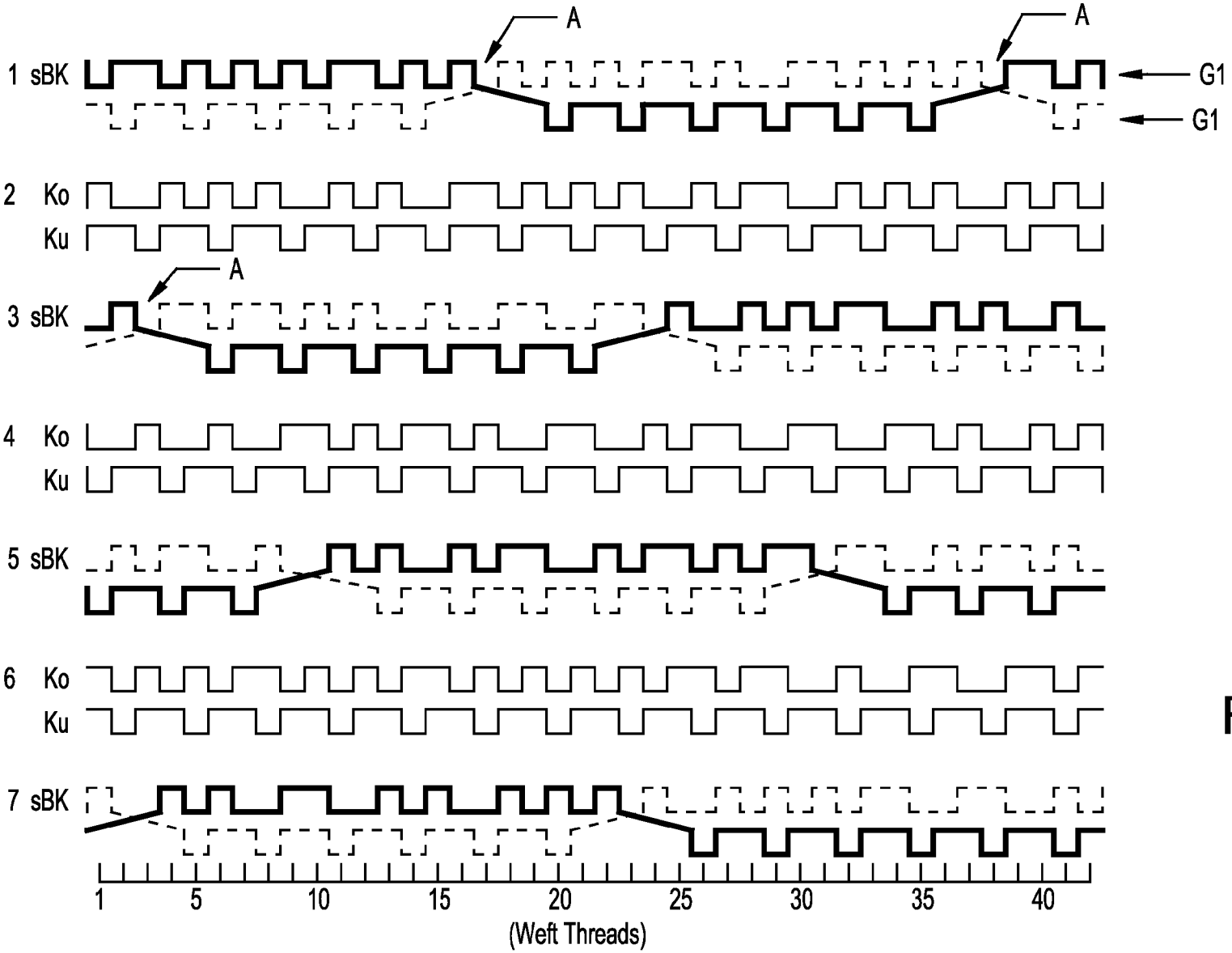
FIGS. 2*a* to 2*f* show the warp thread runs of the warp threads or warp thread pairs 1 to 36 shown in FIG. 1.
Figure 2B:
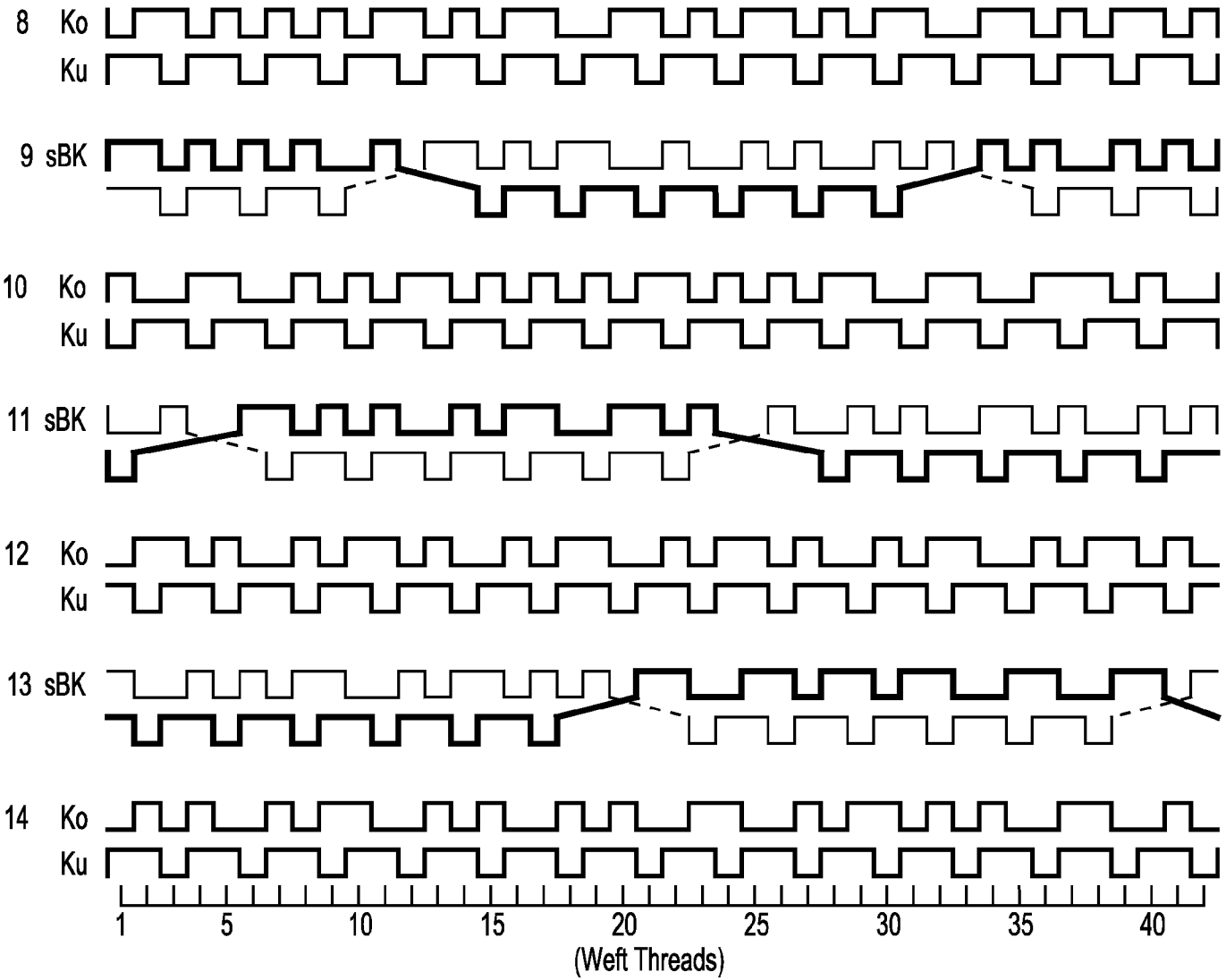
Figure 2C:
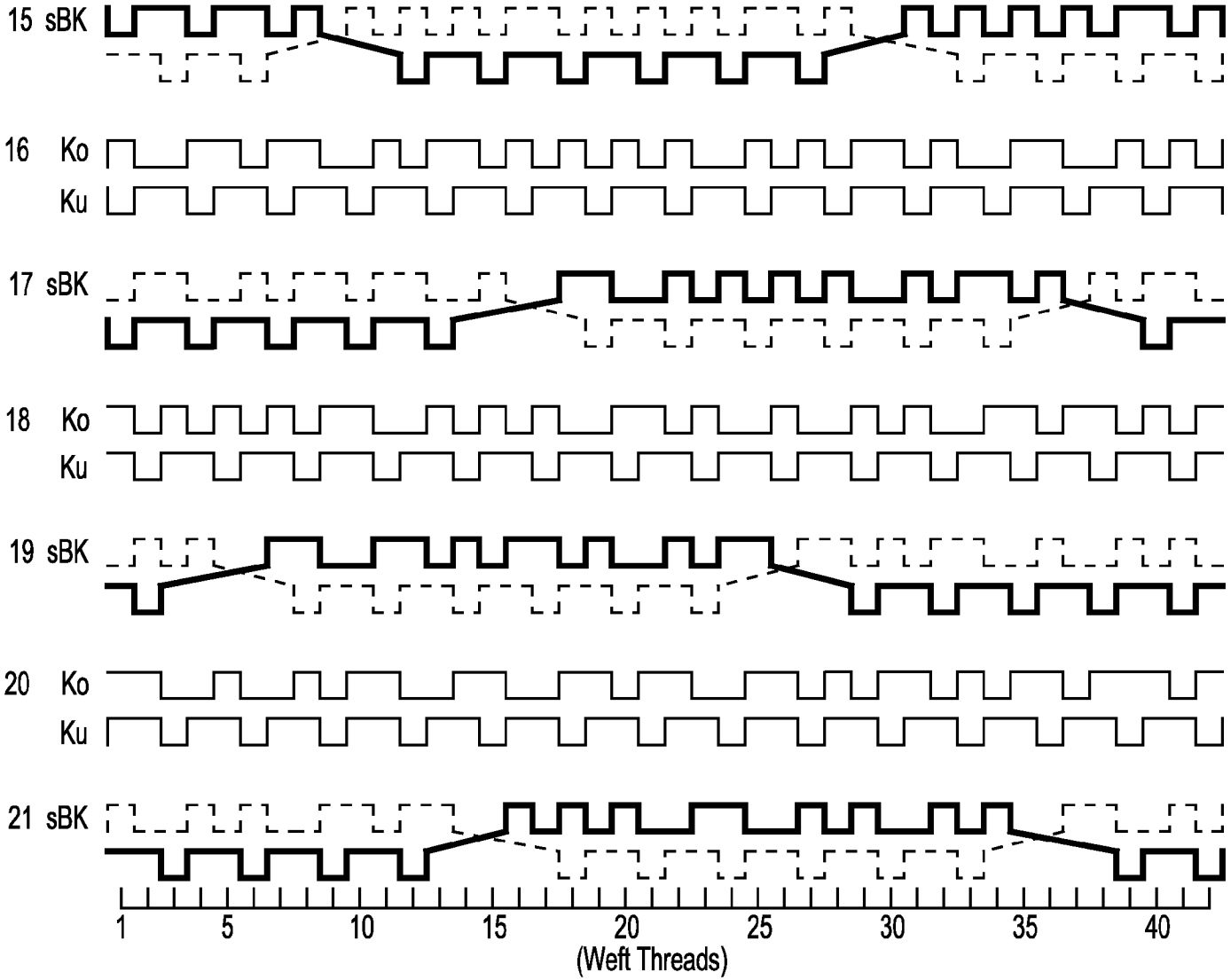
Figure 2D:
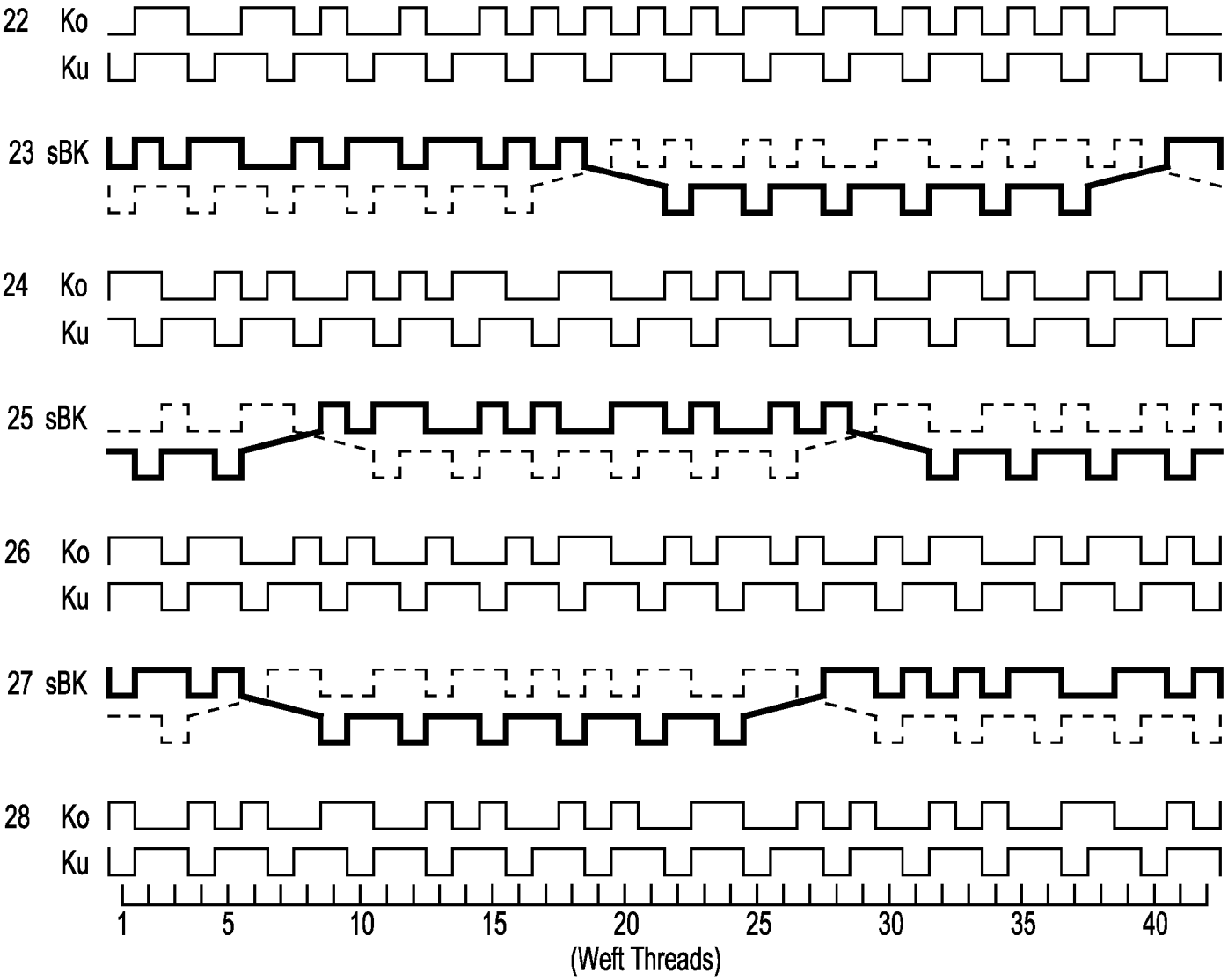
Figure 2E:
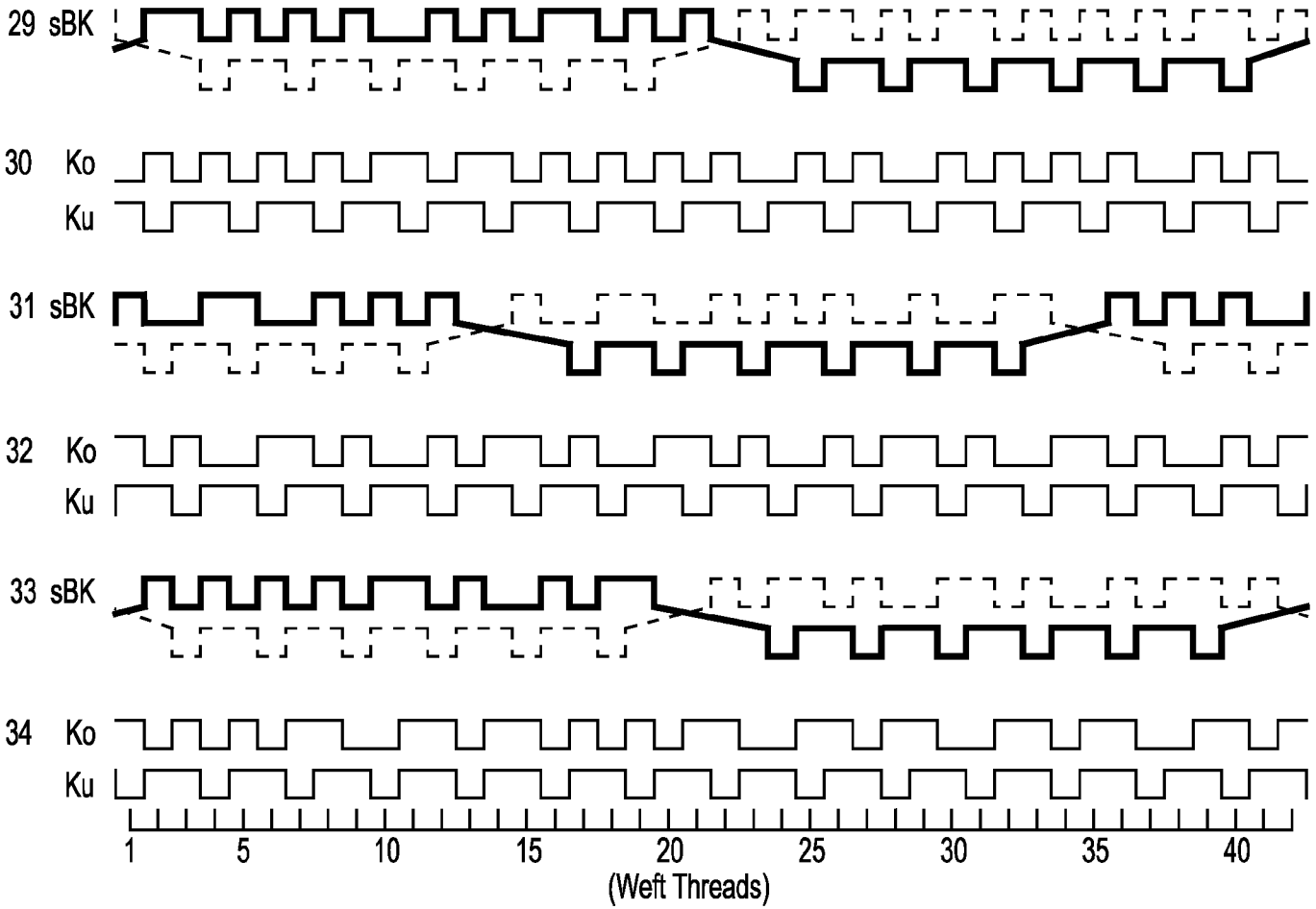
Figure 2F:
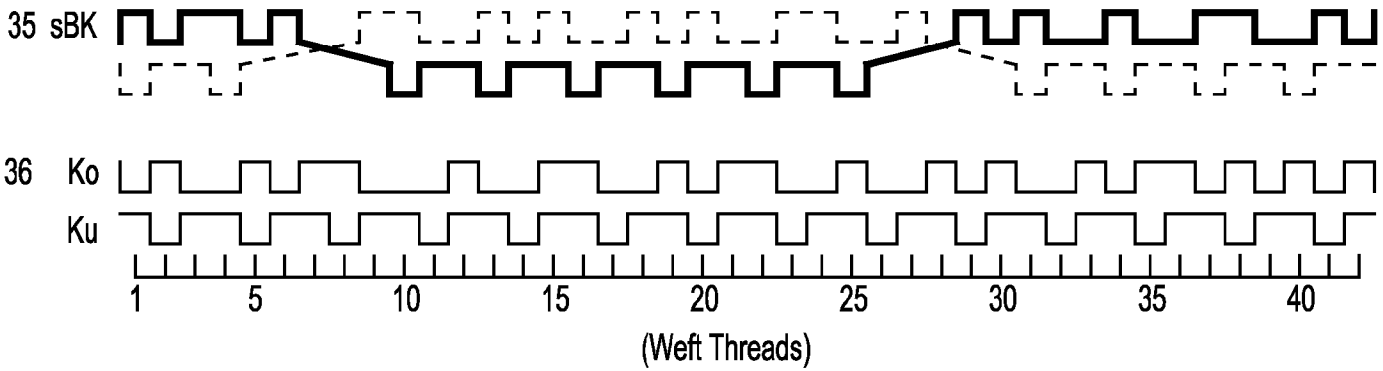

If FIG. 2*a* is considered, for example, then the runs marked in FIG. 1 with 1 to 7 and the structure-forming warp threads woven in the first woven layer G1 are shown. A basic difference in the way the warp threads forming the first woven layer G1 are integrated is that for example the warp threads 2, 4, 6 in FIG. 2*a* and also designated as Ko in the following figures are woven solely in structure-forming manner into the first woven layer G1, meaning that they are tied only to the weft threads 1 to 42 of this first fabric layer. By contrast the "warp threads" designated in FIG. 2*a* with 3, 5 and 7 and also appearing with corresponding numbering in FIG. 1 are formed respectively by a pair of tie warp threads which switch at the respective changeover points A between the first woven layer G1 and the second woven layer G2. Such structure-forming tie warp thread pairs, designated in FIGS. 2*a* to 2*f* as sBK, are formed respectively from two individual warp threads, which in some regions are tied to the weft threads of the first woven layer G1 and thus lie in structure-forming manner on the surface or in the first woven layer G1, but which in some regions are also tied to weft threads of the second woven layer G2 and thus produce a connection between the two woven layers G1 and G2. In order to obtain a continuous structure in the first woven layer G1, when one of these tie warp threads of a respective structure-forming tie warp thread pair switches from the first woven layer G1 into the second woven layer G2, then the other tie warp thread of such a structure-forming tie warp thread pair switches from the second woven layer G2 into the first woven layer G1, thus creating a changeover point A at a respective crossover point.

From FIG. 2*a* to 2*f* and also from FIG. 1 it is evident that in each case a warp thread Ko woven only into the first woven layer changes with such a structure-forming tie warp thread pair sBK, which actually becomes visible in the finished weave pattern on the surface of the woven belt as only a single warp thread.

In order to obtain the greatest possible irregularity in a respective warp/weft repeat on an inventively constructed woven belt and, in so doing, to suppress as far as possible the occurrence of marking effects in the web material to be produced, the tie structure as illustrated in FIGS. 1 and 2*a* to 2*f* is constructed with very great irregularity. Various aspects contribute to this irregularity. For example, each of the warp threads used in the warp/weft repeat R, meaning each warp thread Ko and each tie warp thread contributing to a structure-forming tie warp thread pair sBK, has a different warp run than the other warp threads of said repeat R. This means that actually 54 different warp runs exist in the repeat shown in FIG. 1 for the first woven layer G1 alone. There are namely 18 different warp runs of the warp threads Ko and 2×18 (=36) different warp runs for the structure-forming tie warp thread pairs sBK. A warp run in the context of the current invention is in each case the run of a respective warp thread in relation to the weft threads of the first woven layer G1. By using these many different warp runs, which on account of the pair-wise joining together of certain warp threads to form the respective structure-forming tie warp thread pairs are recognizable on the woven belt actually as 36 different thread runs 1 to 36, it is possible to produce a warp/weft repeat which extends in warp direction over at least 36 "warp threads", wherein in this case the warp threads actually visible on the surface are considered, meaning the structure-forming tie warp thread pairs sBK are interpreted only as a single warp thread existing in the first woven layer G1. Actually a total of 54 warp threads contributes to these 36 recognizable "warp threads".

If use is then made on such a woven belt for the running-side woven layer, meaning the second woven layer G2, of three different warp runs, which are repeated for example periodically on the warp threads Ku respectively woven into only the second woven layer G2, then the tie structure presented in FIG. 1 requires actually 57 different warp runs. For production with a so-called high-shaft machine this means that at least 57 shafts are required to weave such a tie structure.

Another contribution to a greatest possible irregularity is the fact that none of the warp runs are generated only by shifting another of the warp runs by a predefined number of wefts. Each of the warp runs actually forms a completely independent pattern in conjunction with the weft threads viewed in connection therewith.

In addition it is evident above all from FIG. 1 that the distribution of changeover points A, represented there in each case by a field marked with "X", is not subject to any regularity. On the one hand there are structure-forming tie warp thread pairs sBK, on which there are 2 changeover points A within the repeat R, while on other structure-forming warp thread pairs there are 3 changeover points. However, to provide as uniform a connection as possible between the two woven layers G1, G2, each structure-forming warp thread pair sBK has at least 2 changeover points A. In addition steps should be taken to ensure that the number of structure-forming tie warp thread pairs sBK, on which the changeover positions A are in each case on the same wefts, is kept as small as possible. Advantageously there should be no more than three structure-forming tie warp thread pairs on which all changeover points lie on the same weft threads. Also it is advantageous to configure the distribution of changeover points A on the weft threads 1 to 42 as evenly as possible. Hence there should be a changeover point A on at least half of all the weft threads.

Another contribution to as irregular as possible a structure with the smallest possible tendency to marking is made on the inventively constructed woven belt by the fact that the floating length of the structure-forming warp threads in the first woven layer G1, meaning the warp threads Ko in the case of the tie shown in FIGS. 1 and 2*a* to 2*f* and the warp threads of the respective structure-forming tie warp thread pairs sBK, has a floating length of no more than 3 with regard to the weft threads of the first woven layer G1. Actually it is evident from the illustrated example that on the two warp threads Ko 10 and 20 there is respectively one floating which extends over three weft threads, namely the weft threads 36, 37 and 38 in the case of the warp thread Ko 10 and the weft threads 38, 39 and 40 in the case of the warp thread Ko 20. All other floatings extend over fewer than three weft threads. Here it has proven to be particularly advantageous for at least half of the existing floatings to extend over fewer than three threads, meaning fewer than three warp threads or fewer than three weft threads.

Figure 3:
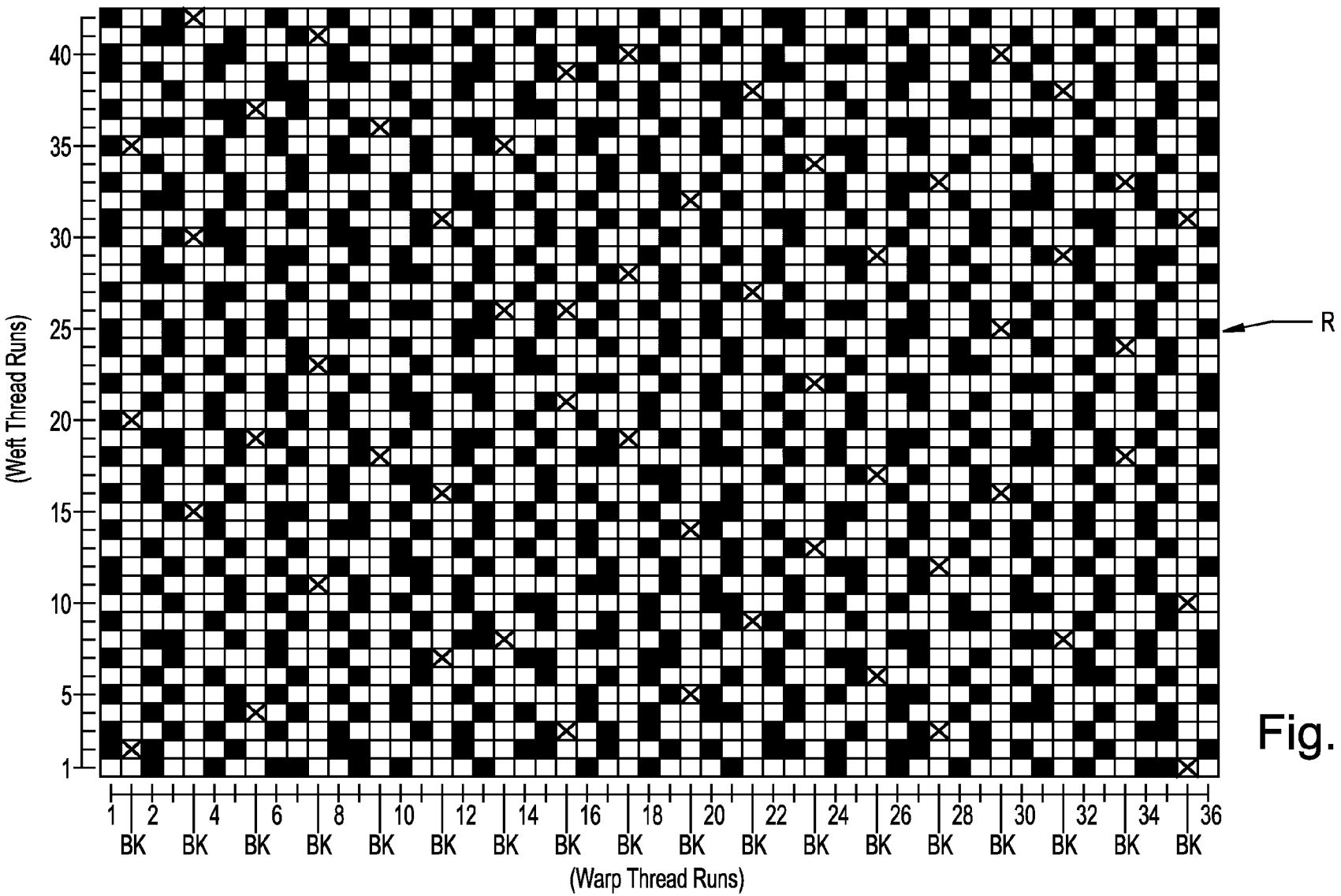
FIG. 3 shows a representation of a warp/weft repeat corresponding to FIG. 1, wherein warp lifts are indicated by black fields, warp lowerings with white fields and tie-on points of tie warp threads with an "X"
Figure 4A:
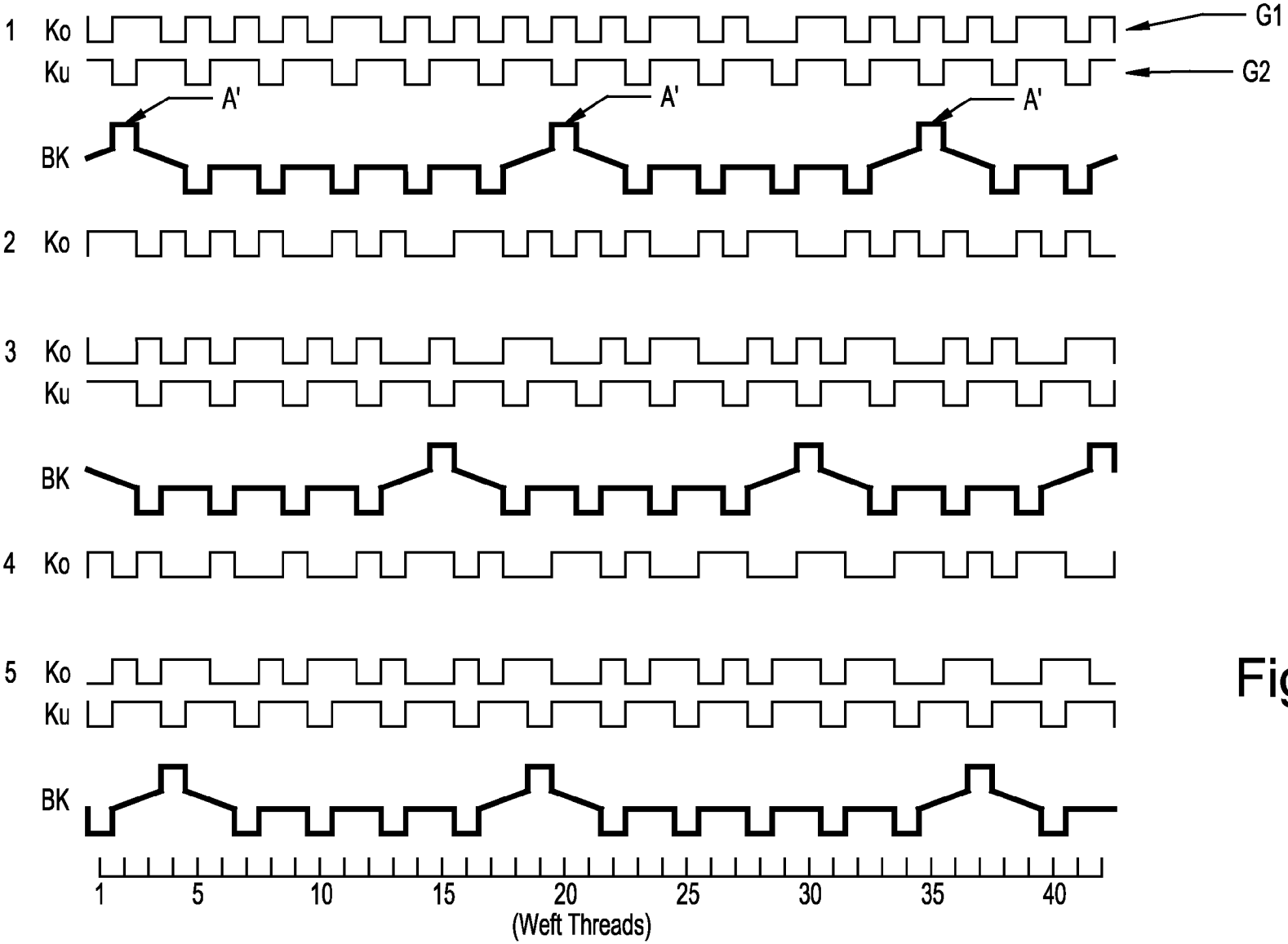
FIGS. 4*a* to 4*g* show the warp thread runs of the structure-forming warp threads drawn in FIG. 3 and the tie warp threads.
Figure 4B:
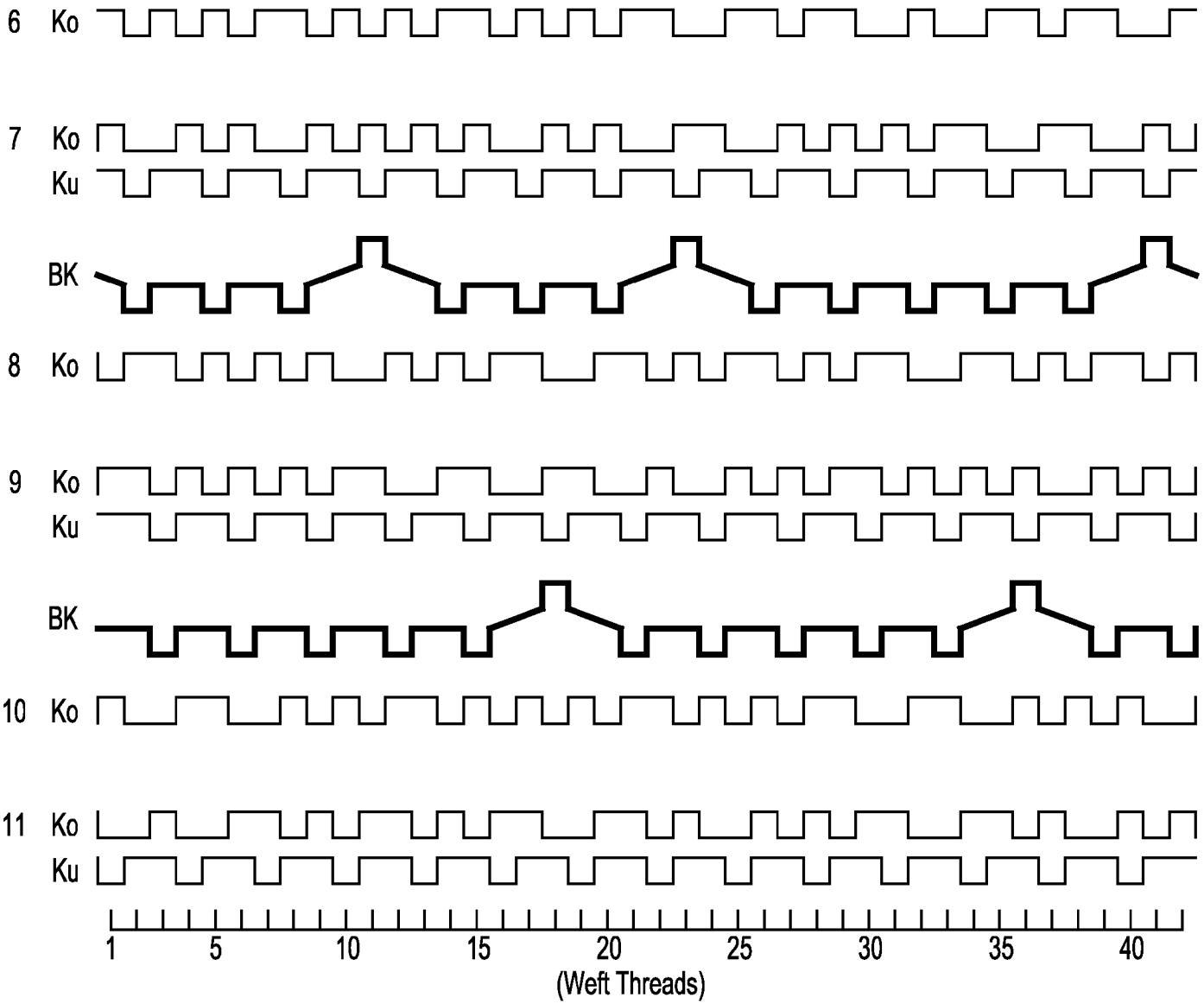
Figure 4C:
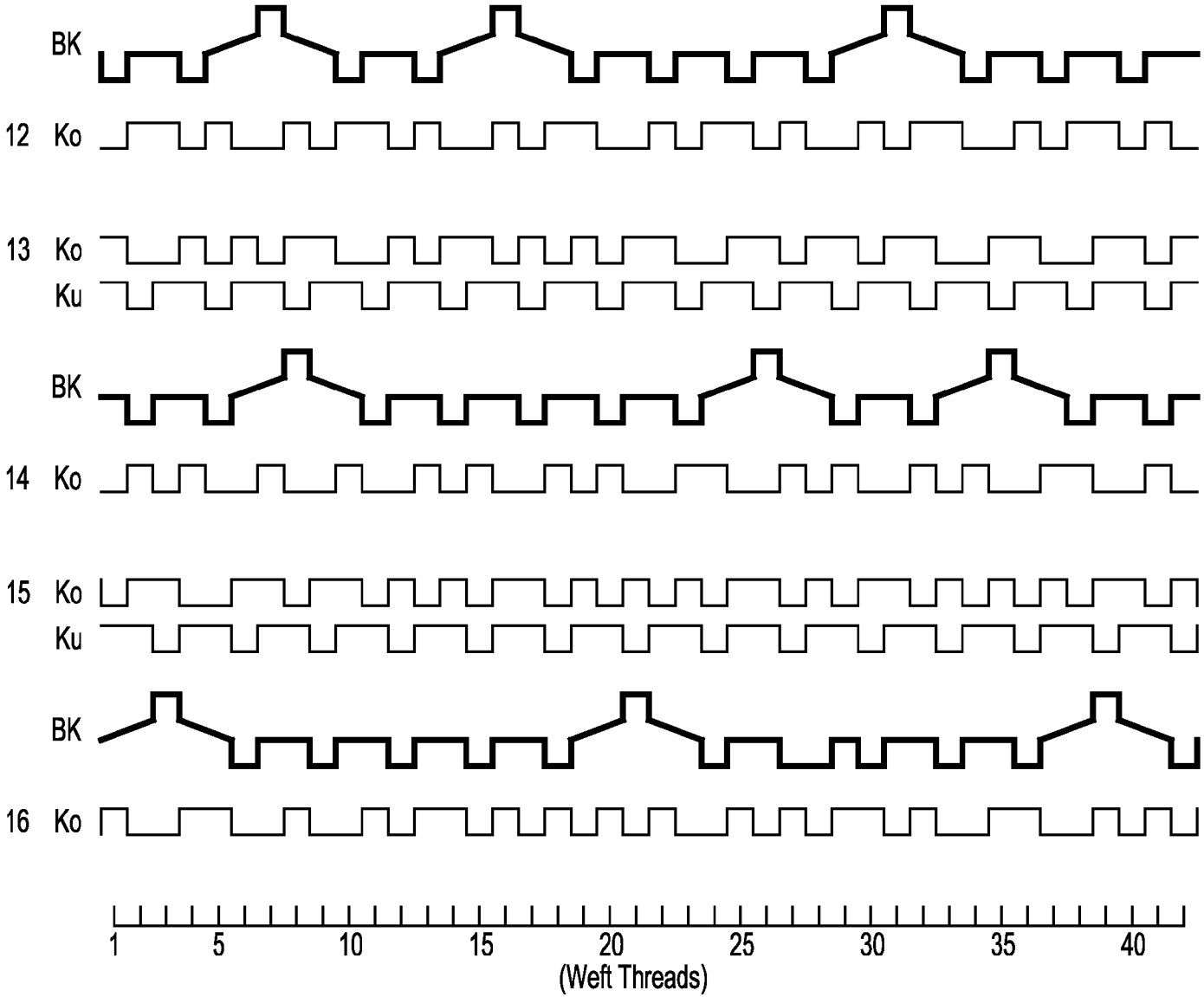
Figure 4D:
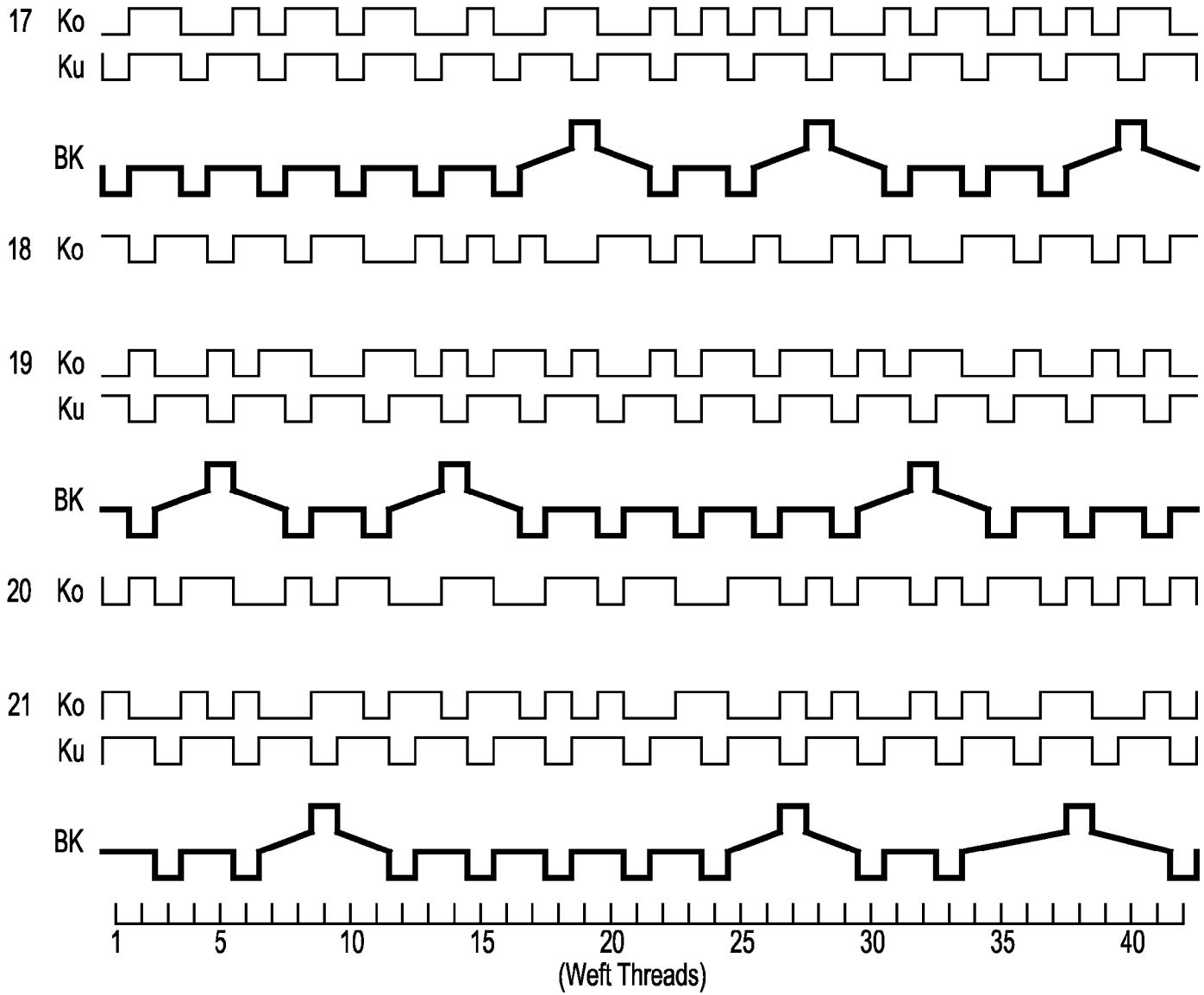
Figure 4E:
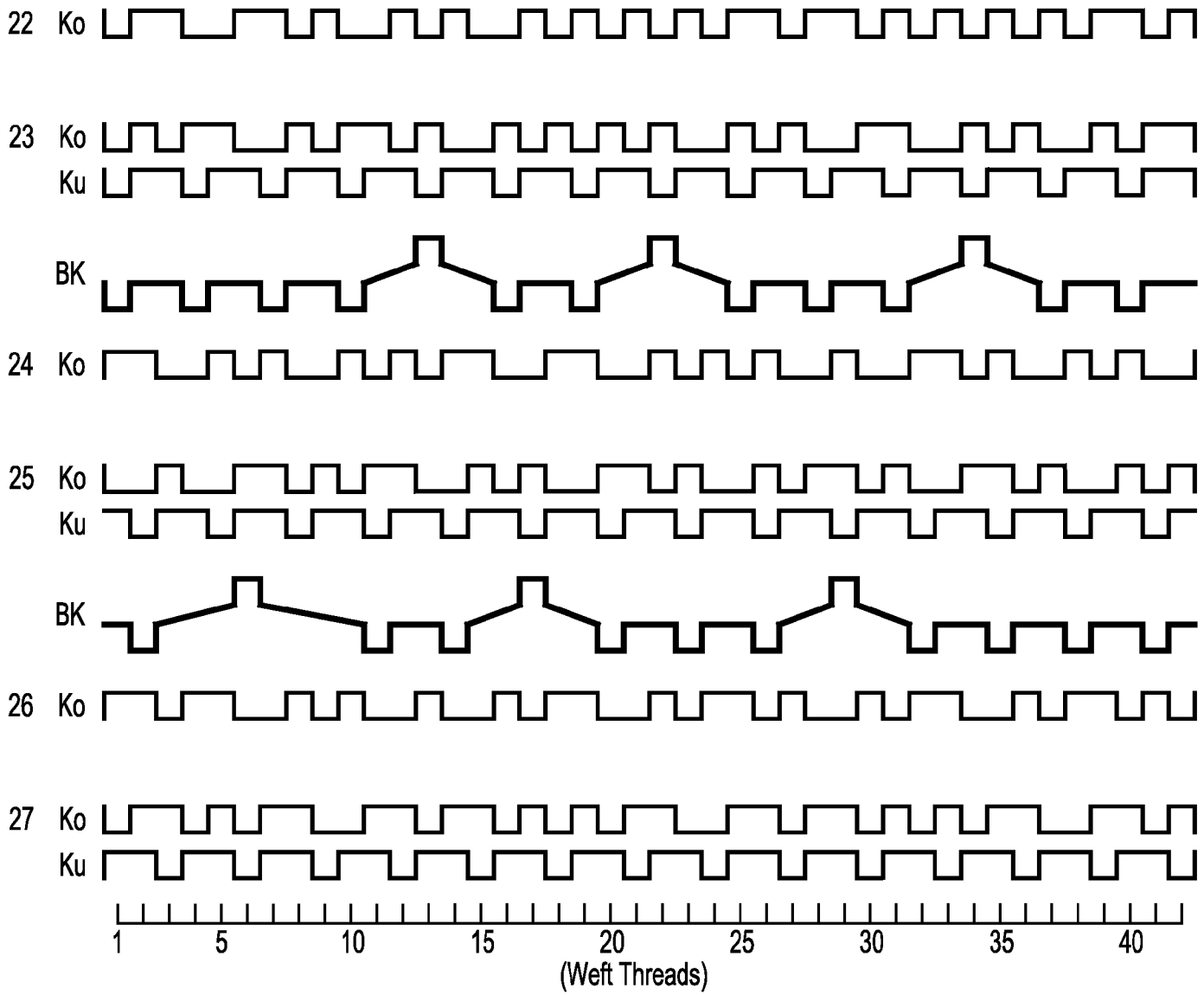
Figure 4F:
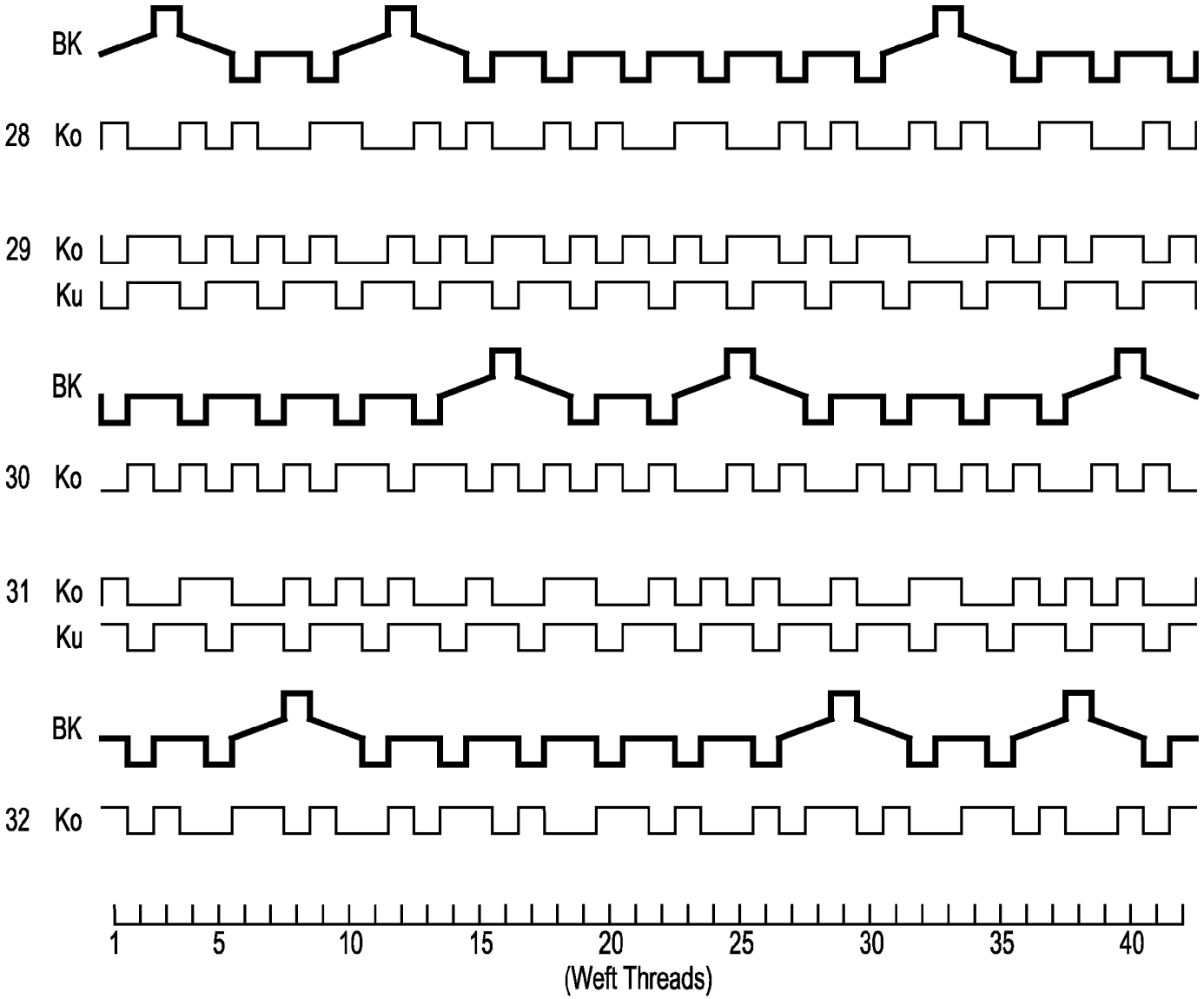
Figure 4G:
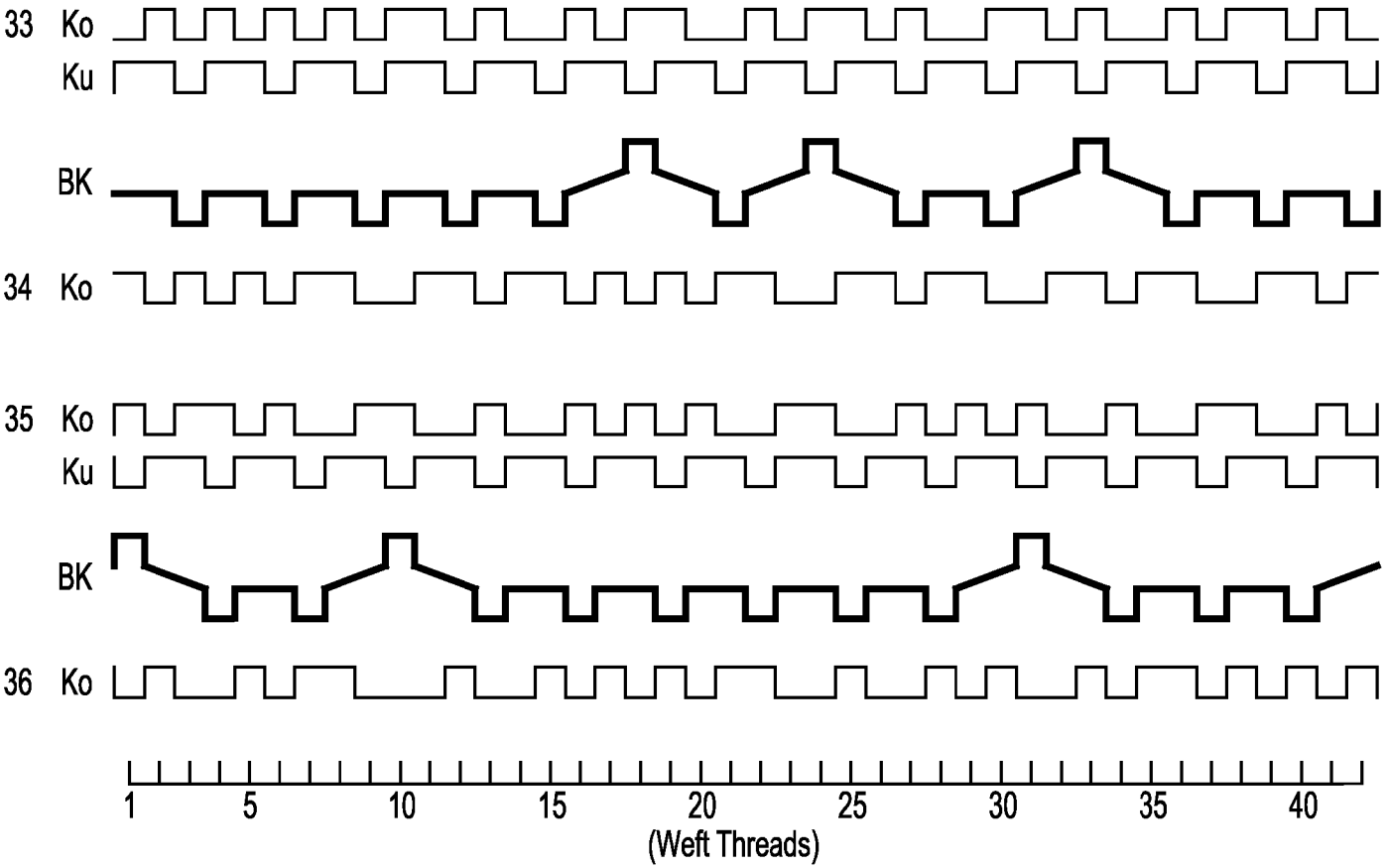

Another embodiment of an inventively constructed woven belt or a tie structure therefor is shown in FIGS. 3 and 4*a* to 4*g*. Here, too, FIG. 3 shows a warp/weft repeat R, which extends over 36 structure-forming warp threads woven into the first woven layer G1 and over 42 weft threads of both the first woven layer G1 and the second woven layer G2. The connection between the two woven layers G1 and G2 is effected in this case by tie warp threads BK which in the essential region of their extension are woven into only the second woven layer G2, meaning that they are tied there over or under the weft threads 1 to 42 of this second woven layer G2. At so-called tie-on points A', however, said tie warp threads BK are tied to weft threads of the first woven layer G1. In the case of the tie warp thread BK arranged between the structure-forming warp threads 1 and 2 of the first woven layer G1, said tie-on points A' are formed in each case on the weft threads 2, 20 and 35 of the first woven layer G1, meaning the tie warp thread BK runs there over the weft threads of the first woven layer G1. Before and afterwards it switches from the second woven layer G2 into the first woven layer G1 or back into the second woven layer G2. Because said tie warp threads on the surface of the first woven layer G1 occur only in the region of the tie-on points A' and otherwise do not appear in the first woven layer G1, they are not referred to as structure-forming because they do not make a notable contribution to the structure of the first woven layer G1.

The greatest possible irregularity is assured also on the tie structure shown in FIGS. 3 and 4*a* to 4*g*. Here, too, a contribution is made by the first woven layer being woven with a multiplicity of different warp runs. This applies initially to the structure-forming warp threads Ko occurring in the first woven layer G1, which in FIG. 3 are numbered from 1 to 36. All the warp runs of these 36 warp threads Ko differ from each other by respectively different tie patterns with the weft threads 1 to 42 of the first woven layer G1, wherein here again none of the warp runs can be generated solely by shifting another warp run in the warp direction. Different warp runs are selected also for the tie warp threads which occur solely at the tie-on points A' in the first woven layer G1, which results among other things in a completely irregular distribution of the tie-on points A'. Such non-structure-forming tie warp threads BK are thus available here for a warp/weft repeat 18 so that the total number of warp runs of warp threads Ko and BK, which occur in the first woven layer G1, again lies at 54. Combined with the three different warp runs for the warp threads Ku woven into only the second woven layer G2 this results in a total number of 57 different warp runs within a warp/weft repeat. Hence such a weave or such a tie structure also requires the use of a high-shaft machine with at least 57 shafts.

In addition it should be noted that for the tie structure shown in FIGS. 3 and 4*a* to 4*g* with regard to the floating of structure-forming warp threads in the first woven layer G1, meaning the warp threads Ko and the weft threads 1 to 42 of the first woven layer woven thereto, the same applies of course as for the preceding embodiment. Here, too, the maximum floating length should not exceed the number 3. Such a floating extending over 3 weft threads can be seen for example on warp thread Ko 29 in FIG. 4*f*. The majority of floatings is selected such that they extend over a maximum of two respectively other threads, meaning warp threads or weft threads.

With regard to the irregular positioning of the tie-on points A' within a respective repeat it should also be noted that said tie-on points should be selected preferably such that on no more than three tie warp threads BK do the tie-on points A' lie respectively on the same weft threads. To the extent that there are such tie warp threads which have all the tie-on points A' on the same weft threads the same as other tie warp threads BK, steps should be taken to ensure that they do not lie directly side by side but are separated by at least one differently integrated tie warp thread. Also care should be taken to ensure that, as is evident in FIG. 3, tie-on points A1 exist on as many as possible of the weft threads existing in such a repeat. At least half of the weft threads should be tied respectively to a tie warp thread BK in order to form such a tie-on point A'.

In the manner previously described it is thus possible to create a tie structure for a woven belt for a machine for producing web material, for example paper or paperboard, on which the occurrence of regular tie patterns is suppressed as far as possible on the one hand through the provision of very large repeats and on the other hand through a very irregular distribution of for example the changeover points A or the tie-on points A' within the respective repeats. A very short floating length also contributes to this. As a result it is possible to obtain a woven belt on which not only is the tendency to marking reduced but a very uniformly distributed connection of the woven layers to each other over the entire woven belt can be maintained.

Finally it should also be noted that the illustrated examples with 54 different warp runs of the first woven layer, meaning the woven layer providing the web material contact side, are of course not limiting for the current invention. It is also possible to use smaller numbers of warp runs or shafts in the weaving process in order to produce comparatively large repeats. For example, it is possible of course for a certain number of warp runs to be repeated within a respective repeat, thus producing repeats which have for example 26 different warp runs and extend over 40 or more warp threads or structure-forming warp thread pairs. The number of 26 different warp runs has proven to be advantageous. It is also possible to use 30 different warp runs or 36 different warp runs as a lower limit, thus resulting in correspondingly larger repeats.

The previously described inventively constructed woven belt can also be used in particular for the production of voluminous paper, in particular tissue paper or bulky tissue paper. When assigned to such voluminous paper, which therefore has a lower gsm (grams per square meter) substance, the warp and weft specifications can then be selected accordingly, for example the density and diameter of the warp threads and/or weft threads, which are interrelated variables.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A woven belt for a machine for producing a web of fibrous material, said woven belt comprising:

at least two woven layers including a first woven layer and a second woven layer, each of said at least two woven layers including a plurality of warp threads extending in a belt longitudinal direction and a plurality of weft threads extending in a belt transverse direction, said first woven layer forming a web contact side, said second woven layer forming a machine contact side, said plurality of warp threads including a plurality of tie warp threads and a plurality of structure-forming warp threads, said first and second woven layers joining together by said plurality of tie warp threads, said first woven layer being woven with at least 26 different warp thread runs, said plurality of structure-forming warp threads being woven into said first woven layer, said plurality of weft threads of said first woven layer having a maximum floating length of 3 relative to each other, wherein one of:

(1) said plurality of tie warp threads includes a plurality of structure-forming tie warp thread pairs such that where a tie warp thread of a respective said structure-forming tie warp thread pair is integrated into said first woven layer an other tie warp thread of said structure-forming tie warp thread pair is integrated into an other woven layer of said at least two woven layers, and said tie warp threads of said plurality of structure-forming tie warp thread pairs cross each other so as to switch between said first woven layer and said other woven layer of said at least two woven layers and form a plurality of changeover points which are distributed irregularly within a warp/weft repeat, and (2) said plurality of tie warp threads are integrated into said first woven layer with no structure-forming effect and tie onto a plurality of tie-on points over said plurality of weft threads of said first woven layer, and said plurality of tie-on points are distributed irregularly within said warp/weft repeat.

2. The woven belt according to claim 1, wherein each of said plurality of structure-forming tie warp thread pairs within said warp/weft repeat has at least two of said plurality of changeover points and all of said plurality of changeover points on no more than two of said plurality of structure-forming tie warp thread pairs lie on same ones of said plurality of weft threads of said first woven layer.

3. The woven belt according to claim 1, wherein each of said plurality of structure-forming tie warp thread pairs within said warp/weft repeat has at least two of said plurality of changeover points and none of said plurality of changeover points on said plurality of structure-forming tie warp thread pairs lies on a same one of said plurality of weft threads of said first woven layer.

4. The woven belt according to claim 1, wherein within one said warp/weft repeat there are no more than three of said plurality of structure-forming tie warp thread pairs on which all of said plurality of changeover points lie on same ones of said plurality of weft threads of said first woven layer.

5. The woven belt according to claim 1, wherein at least one of said plurality of changeover points is on at least half of said plurality of weft threads within said warp/weft repeat.

6. The woven belt according to claim 1, wherein said plurality of tie warp threads which are integrated into said first woven layer with no structure-forming effect and which tie onto said plurality of tie-on points over said plurality of weft threads of said first woven layer are a plurality of non-structure-forming tie warp threads, each of said plurality of non-structure-forming tie warp threads within said warp/weft repeat having at least two of said plurality of tie-on points in said first woven layer, all of said plurality of tie-on points on no more than two of said plurality of non-structure-forming tie warp threads lying on same ones of said plurality of weft threads of said first woven layer.

7. The woven belt according to claim 6, wherein none of said plurality of tie-on points on said plurality of non-structure-forming tie warp threads lies on a same one of said plurality of weft threads of said first woven layer.

8. The woven belt according to claim 6, wherein said plurality of tie warp threads which are integrated into said first woven layer with no structure-forming effect and which tie onto said plurality of tie-on points over said plurality of weft threads of said first woven layer are a plurality of non-structure-forming tie warp threads, within one said warp/weft repeat there being no more than three of said plurality of non-structure-forming tie warp threads on which all of said plurality of tie-on points lie on same ones of said plurality of weft threads of said first woven layer.

9. The woven belt according to claim 1, wherein on at least half of said plurality of weft threads of said first woven layer is at least one of said plurality of tie-on points.

10. The woven belt according to claim 1, wherein said other woven layer of said at least two woven layers is said second woven layer.

11. The woven belt according to claim 1, wherein said plurality of warp threads includes a plurality of warp threads in said first woven layer which do not contribute to connecting said at least two woven layers, a number of one of said plurality of structure-forming tie warp thread pairs and said plurality of non-structure-forming tie warp threads being one of smaller than and equal to a number of said plurality of warp threads in said first woven layer which do not contribute to connecting said at least two woven layers.

12. The woven belt according to claim 1, wherein a number of said plurality of warp threads of said first woven layer is one of greater than and equal to a number of said plurality of warp threads of said second woven layer.

13. The woven belt according to claim 1, wherein a number of said plurality of weft threads of said first woven layer is one of greater than and equal to a number of said plurality of weft threads of said second woven layer.

14. The woven belt according to claim 1, wherein all of said plurality of warp threads within said warp/weft repeat have different warp runs.

15. The woven belt according to claim 1, wherein said plurality of structure-forming threads woven into said first woven layer and said plurality of weft threads of said first woven layer relative to each other form therebetween a plurality of floatings, at least half of said plurality of floatings having a floating length of less than 3.

16. The woven belt according to claim 1, wherein at least two of said at least 26 different warp thread runs are formed not by shifting another warp thread run in a warp direction.

17. The woven belt according to claim 1, wherein none of said at least 26 different warp thread runs are formed by shifting another warp thread run in a warp direction.

18. A method for manufacturing a woven belt for a machine for producing a web of fibrous material, said method comprising the steps of:

providing the woven belt including at least two woven layers including a first woven layer and a second woven layer, each of said at least two woven layers including a plurality of warp threads extending in a belt longitudinal direction and a plurality of weft threads extending in a belt transverse direction, said first woven layer forming a web contact side, said second woven layer forming a machine contact side, said plurality of warp threads including a plurality of tie warp threads and a plurality of structure-forming warp threads, said first and second woven layers joining together by said plurality of tie warp threads;

weaving said first woven layer being woven with at least 26 shafts;

weaving said plurality of structure-forming warp threads into said first woven layer, said plurality of weft threads of said first woven layer having a maximum floating length of 3 relative to each other; and one of (1) said plurality of tie warp threads including a plurality of structure-forming tie warp thread pairs such that where a tie warp thread of a respective said structure-forming tie warp thread pair is integrated into said first woven layer an other tie warp thread of said structure-forming tie warp thread pair is integrated into an other woven layer of said at least two woven layers, and said tie warp threads of said plurality of structure-forming tie warp thread pairs crossing each other so as to switch between said first woven layer and said other woven layer of said at least two woven layers and forming a plurality of changeover points which are distributed irregularly within a warp/weft repeat, and (2) integrating said plurality of tie warp threads into said first woven layer with no structure-forming effect and tying said plurality of tie warp threads onto a plurality of tie-on points over said plurality of weft threads of said first woven layer, and distributing said plurality of tie-on points irregularly within said warp/weft repeat.

* * * * *